US009441826B2

(12) United States Patent
Chang et al.

(10) Patent No.: US 9,441,826 B2
(45) Date of Patent: Sep. 13, 2016

(54) LIGHTING APPARATUS

(71) Applicant: LG ELECTRONICS INC., Seoul (KR)

(72) Inventors: Hyeuk Chang, Seoul (KR); Jeongseok Ha, Seoul (KR); Jaepyo Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 190 days.

(21) Appl. No.: 14/503,570

(22) Filed: Oct. 1, 2014

(65) Prior Publication Data

US 2015/0103527 A1 Apr. 16, 2015

(30) Foreign Application Priority Data

Oct. 15, 2013 (KR) ..... 10-2013-0122609

(51) Int. Cl.

| | |
|---|---|
| ***F21V 29/00*** | (2015.01) |
| ***F21V 29/71*** | (2015.01) |
| ***F21V 29/51*** | (2015.01) |
| *F21Y 101/02* | (2006.01) |
| *F21Y 105/00* | (2016.01) |

(52) U.S. Cl.

CPC ..... *F21V 29/717* (2015.01); *F21V 29/51* (2015.01); *F21Y 2101/02* (2013.01); *F21Y 2105/001* (2013.01)

(58) Field of Classification Search

CPC .... F21Y 2101/02; F21V 29/00; F21V 29/51; F21V 29/717; F21V 2105/001; F28F 1/128; F28F 1/325; F28F 13/12

USPC ..... 362/294, 373; 165/151–152

See application file for complete search history.

(56) References Cited

U.S. PATENT DOCUMENTS

2009/0230834 A1* 9/2009 Liu ..... F21V 23/02 313/12
2009/0237933 A1 9/2009 Liu
2012/0098401 A1* 4/2012 Yu ..... F21V 29/004 313/46

OTHER PUBLICATIONS

European Search Report dated Feb. 25, 2015 issued in Application No. 14185529.6.

* cited by examiner

*Primary Examiner* — Laura Tso
*Assistant Examiner* — Naomi M Wolford
(74) *Attorney, Agent, or Firm* — KED & Associates, LLP

(57) ABSTRACT

There is disclosed a lighting apparatus including t light emitting unit including a light emitting part having a LED, a base part in which the light emitting part is mounted, a plurality of heat pipes fixed to the base part, and a plurality of heat radiation plates comprising a plurality of insertion holes to pass the plurality of the heat pipes there through and a flow hole for flowing external air there through, respectively, wherein a plurality of auxiliary pin arrays comprising a plurality of auxiliary pins inclined a preset angle are provided in each of the heat radiation plates, and a turbulence generation unit for generating turbulence flow when external air is flowing is provided in the auxiliary pin.

20 Claims, 10 Drawing Sheets

(a)

(b)

LIGHTING APPARATUS

Pursuant to 35 U.S.C. §119(a), this application claims the benefit of earlier filing date and right of priority to Korean Application No. 10-2013-0122609, filed on Oct. 15, 2013, the contents of which are hereby incorporated by reference herein in their entirety.

BACKGROUND OF THE DISCLOSURE

1. Field of the Disclosure

Embodiments of the present disclosure relates to a lighting apparatus, more particularly, to a lighting apparatus having an advanced heat radiation function.

2. Discussion of the Related Art

Recently, interest in light emitting diodes (LEDs) has increased, because they have advantages of efficiency, color diversion, design autonomy and so on.

A light emitting diode (LED) is a semiconductor element for emitting light when a voltage is applied thereto forwardly. The light emitting diode has a long life span and low power consumption and it also has electrical, optical and physical characteristics proper to mass production. Accordingly, the light emitting diodes replace incandescent lamps and fluorescent lamps rapidly.

Meanwhile, the light emitting diode (LED) requires a heat radiation structure for releasing the heat generated therein and a metallic heat sink is used in radiating the heat generated in the light emitting diode outside.

A heat sink used for a conventional LED lighting apparatus generates air convection only in an outer circumferential surface and it is difficult to increase an area of air convection generated for heat exchange. In addition, heat exchange is disadvantageously generated only in a portion distant from a heat generation source such as a light emitting diode.

SUMMARY OF THE DISCLOSURE

Embodiments of the present disclosure provide a lighting apparatus having an advanced heat radiation function.

Embodiments of the present disclosure provide a lighting apparatus in which a plurality of air passages may be formed in different directions to radiate the heat generated in a light emitting unit.

Embodiments of the present disclosure provide a lighting apparatus which may generate turbulence flow in a process of flowing external air for heat radiation.

Embodiments of the present disclosure provide a lighting apparatus which enables modulation, using an increased or decreased number of light emitting units.

Embodiments of the present disclosure provide a lighting apparatus which may provide an advanced durability and watertightness.

Embodiments of the present disclosure provide a lighting apparatus which may increase optical efficiency by compensating an index of refraction.

Embodiments of the present disclosure provide a lighting apparatus which can reduce manufacture cost and simplify manufacturing processes.

To achieve these objects and other advantages and in accordance with the purpose of the disclosure, as embodied and broadly described herein, a lighting apparatus includes a light emitting part having a LED; a base part in which the light emitting part is mounted; a plurality of heat pipes fixed to the base part; and a plurality of heat radiation plates comprising a plurality of insertion holes to pass the plurality of the heat pipes there through and a flow hole for flowing external air there through, respectively, wherein a plurality of auxiliary pin arrays comprising a plurality of auxiliary pins inclined a preset angle are provided in each of the heat radiation plates, and a turbulence generation unit for generating turbulence flow when external air is flowing is provided in the auxiliary pin.

The turbulence generation unit may include a plurality of dimples formed in one surface of the auxiliary pin.

The dimple may be projected toward the flow hole.

The turbulence generation unit may include a flow guide unit for guiding the air flowing to one surface of the auxiliary pin to the other surface of the auxiliary pin when external air is passing the auxiliary pin.

The flow hole may be provided in a center of the heat radiation plate, and the plurality of the insertion holes may be provided along a circumferential direction with respect to the flow holes, respectively and the auxiliary pin array may be provided in a space between two neighboring insertion holes.

A plurality of auxiliary pins provided in the auxiliary pin array may be spaced apart a preset distance from each other along a radial direction of the heat radiation plate, and the auxiliary pin may be inclined toward the flow hole.

A penetration hole may be provided in the base part to penetrate a cable electrically connected to the light emitting part, and the cable may be exhausted outside via a flow hole of the heat radiation plate.

A first direction air passage may be provided along a space between flow holes of neighboring heat radiation plates and a second direction air passage may be provided in a space between neighboring heat radiation plates, and a third direction air passage may be formed of which a direction is different from the first and second direction air passages, when external air passes the auxiliary pin.

The first direction air passage and the second direction air passage may lie at right angles to each other.

The light emitting part may include a substrate in which a plurality of LEDs are mounted; a reflective member for surrounding each of the LEDs; and a silicon layer filled in the reflective member to surround each of the LEDs.

The reflective member may include a plurality of recesses having a diameter getting larger as farther from each of the LEDs, and the silicon layer may be provided in each of the recesses.

In another aspect, a lighting apparatus includes a light emitting part having an LED; a base part in which the light emitting part is mounted; a plurality of heat pipes fixed to the base part; a plurality of heat radiation plates comprising a plurality of insertion holes to pass the plurality of the heat pipes there through and a flow hole for flowing external air there through, respectively, wherein a plurality of auxiliary pin arrays comprising a plurality of auxiliary pins inclined a preset angle are provided in each of the heat radiation plates and the flow hole is provided in a center of the heat radiation plate and the plurality of the insertion holes are provided along a circumferential direction with respect to the flow hole and the auxiliary pin array is provided in a space between two neighboring insertion holes.

The plurality of auxiliary pins provided in the auxiliary pin array may be spaced apart a preset distance from each other along a radial direction of the heat radiation plate and the auxiliary pin may be inclined toward the flow hole.

A penetration hole may be provided in the base part to penetrate a cable electrically connected to the light emitting part and the cable may be exhausted outside via a flow hole of the heat radiation plate.

A first direction air passage may be provided along a space between flow holes of neighboring heat radiation plates and a second direction air passage may be provided in a space between neighboring heat radiation plates and a third direction air passage may be formed of which a direction is different from the first and second direction air passages, when external air passes the auxiliary pin.

The first direction air passage and the second direction air passage may lie at right angles to each other.

The light emitting part may include a substrate in which a plurality of LEDs are mounted; a reflective member for surrounding each of the LEDs; and a silicon layer filled in the reflective member to surround each of the LEDs.

The reflective member may include a plurality of recesses having a diameter getting larger as farther from each of the LEDs and the silicon layer is provided in each of the recesses.

A turbulence generation unit for generating turbulence flow when external air is flowing may be provided in the auxiliary pin.

The turbulence generation unit may be a plurality of dimples formed in one surface of the auxiliary pin or a flow guide unit for guiding the air flowing to one surface of the auxiliary pin to the other surface of the auxiliary pin, when air passes the auxiliary pin.

The effects of the wireless sound equipment according to the embodiments of the disclosure will be as follows.

The lighting apparatus may increase an air convection heat exchange area, using the heat radiation plate, and the plurality of the air passages with different directions may enhance heat radiation performance.

Furthermore, the turbulence flow is generated in the flowing of the external air passing the light emitting unit such that the heat radiation performance can be enhanced more.

Still further, the lighting apparatus may be modularized by increasing or decreasing the number of the light emitting units. Accordingly, the manufacturing cost can be reduced and the manufacturing process can be simplified.

Still further, the lighting apparatus has the water-proof structure and compensate the refractive index. Accordingly, the optical efficiency can be enhanced.

It is to be understood that both the foregoing general description and the following detailed description are exemplary and explanatory and are intended to provide further explanation of the disclosed subject matter as claimed.

DESCRIPTION OF SPECIFIC EMBODIMENTS

Figure 1:
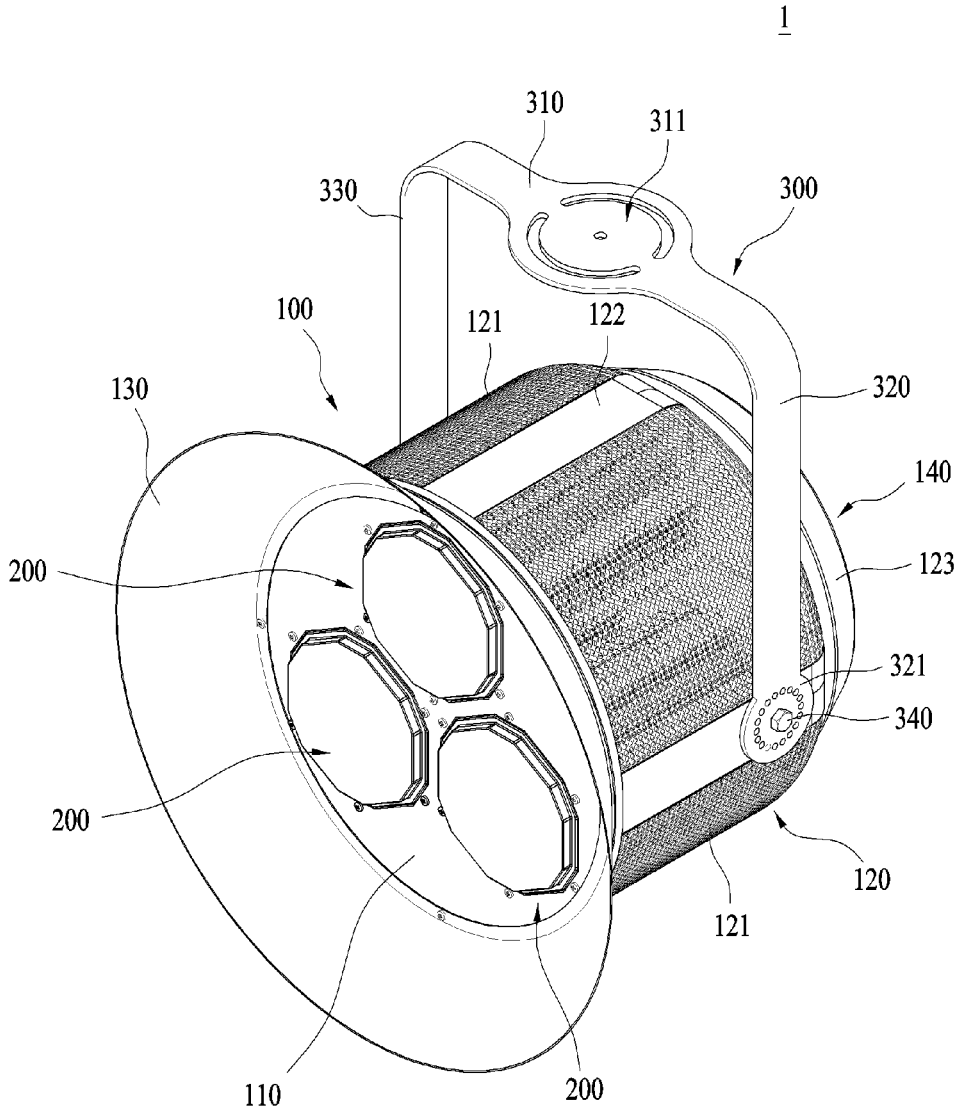
FIG. 1 is a perspective diagram of a lighting apparatus according to one embodiment of the disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. Like reference numerals in the drawings denote like elements.

FIG. 1 is a perspective diagram of a lighting apparatus 1 according to one embodiment of the disclosure.

Figure 9:
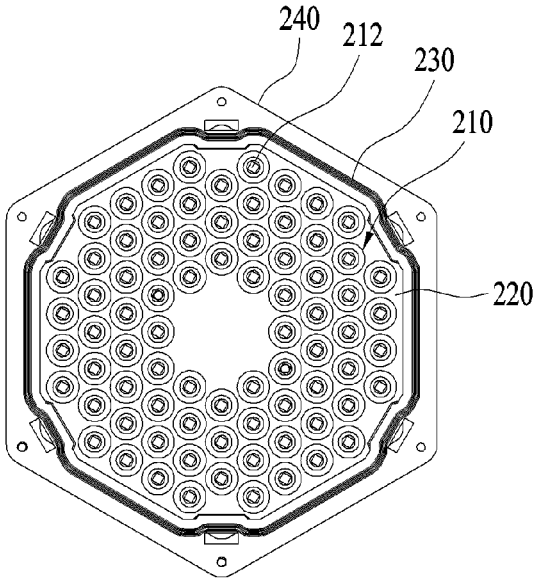
FIG. 9 is a front view of the light emitting unit according to the disclosure.

Referring to FIG. 1, the lighting apparatus according to one embodiment of the disclosure includes a case 100 having a light emitting unit (210, see FIG. 9). The lighting apparatus 1 may further include a bracket 300 for adjusting an installation angle for the case 100.

The bracket 300 is functioned to change a radiation angle of the light emitting unit 210. The case 100 may be rotatably coupled to the bracket 300.

In one embodiment, the bracket 300 may include a first member 311 having a coupling portion 311 coupled to an installation space.

The bracket 300 may also, include a second member 320 and a third member 330 extended from both longitudinal ends of the first member 311. Specifically, the bracket 300 may have a "ㄷ" shape.

The second member 320 and the third member 330 may be rotatably coupled to the case 100. The second member 320 and the third member 330 may have the same structure and the second member 320 will be described as one example of the members.

In one embodiment, the second member 320 may be coupled to the case 100 via a rotation shaft 340. A rotation coupling portion 321 may be provided in one rotary end of the second member 320.

An indicator (not shown) may be provided in the rotation coupling portion 321 to indicate an inclination angle of the case 100. The shaft 340 may be connected to the case 100, penetrating the rotation coupling portion 321.

The case 100 may include a light emitting unit 200 a base plate 110 where the light emitting unit 200 is mounted. A plurality of light emitting units 200 may be mounted in the base plate 110.

The case 100 may include a cover member 120 coupled to the base plate 110 to cover the light emitting unit 200.

In addition, the case 100 may include an electric control unit 140 for supplying an electric power to the light emitting unit 200. The electric control unit 140 may be provided in the cover member 120 not to be exposed outside.

The light emitting unit 200 may be partially exposed outside via the base plate 110 (for instance, a light emitting part) and the other portion is located in a space between the base plate 110 and the cover member 120.

The cover member 120 includes a plurality of mesh materials 121 provided along a circumferential direction and a support material 122 for connecting neighboring mesh materials 121 with each other.

In one embodiment, the bracket 300 may be rotatably coupled to the support material 122.

The cover member includes a rear cover 123 for covering the electric control unit 140. The mesh material 121 has a plurality of flow holes (not shown) through which external air can flow to an inner or outer space of the cover member 120.

The case 100 include a reflection shade 130 for reflecting the light irradiated from the light emitting unit 200. The reflection shade 130 may be provided in the base plate 110.

Figure 2:
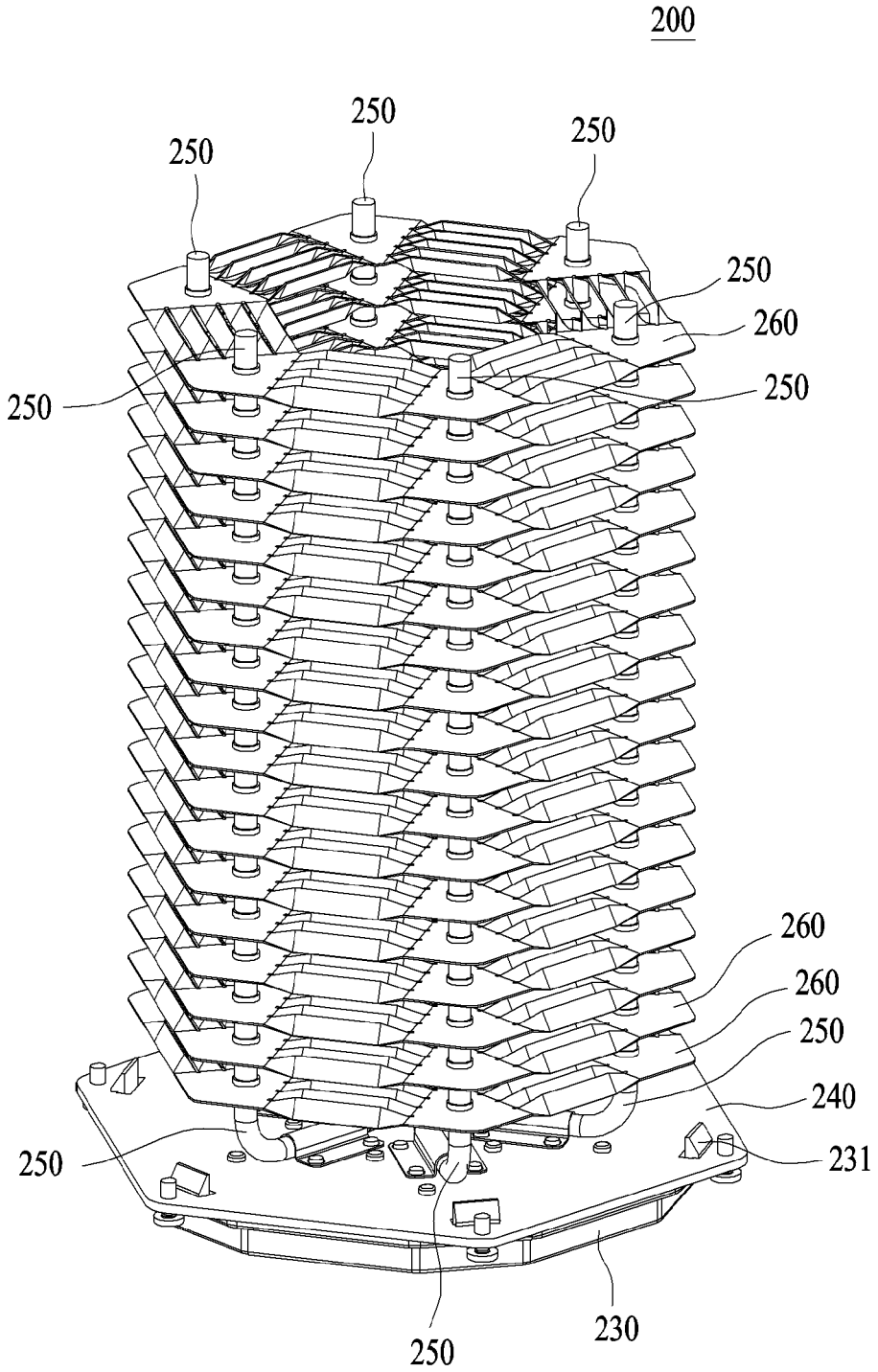
FIG. 2 is a perspective diagram of a light emitting unit provided in the light emitting apparatus according to one embodiment of the disclosure.
Figure 3:
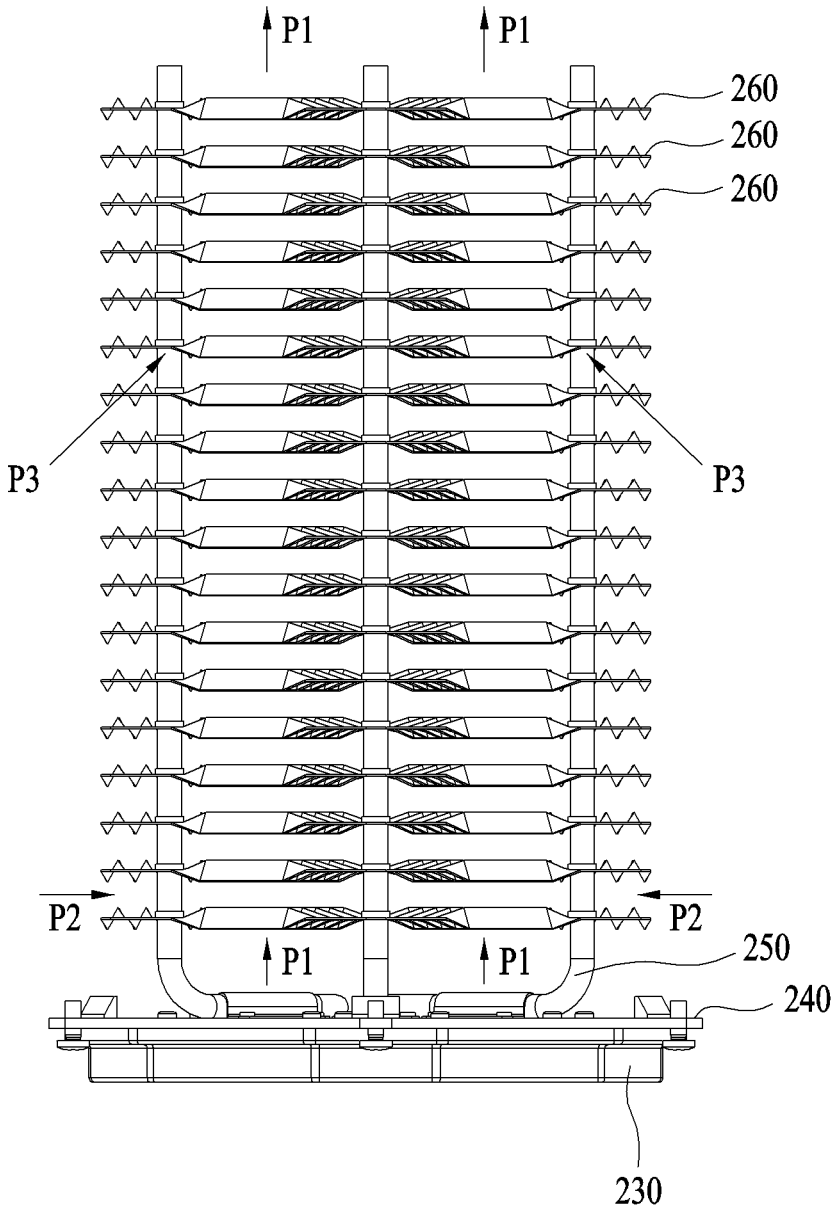
FIG. 3 is a lateral diagram of the light emitting unit shown in FIG. 2.
Figure 4:
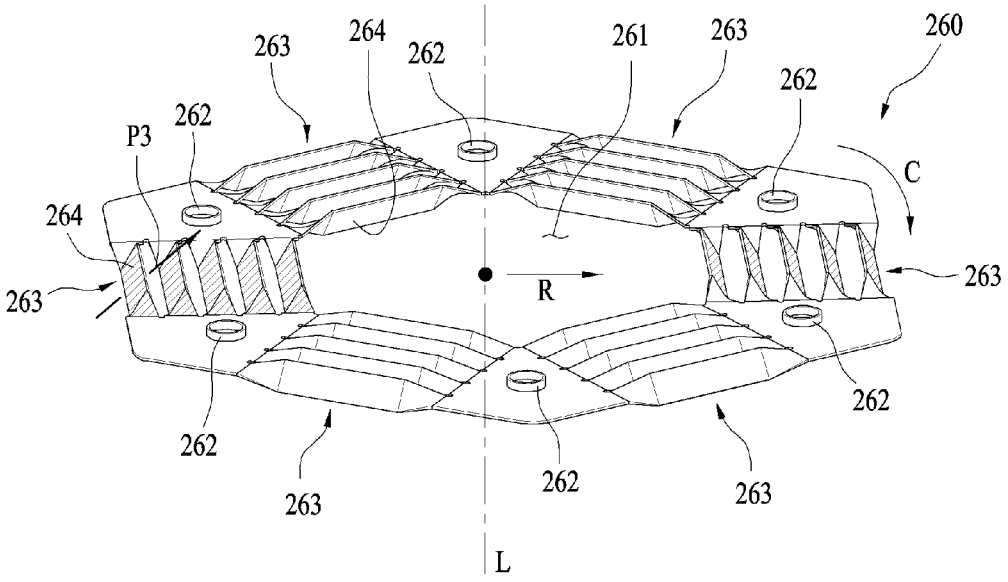
FIG. 4 is a perspective diagram illustrating a first embodiment of a heat radiation plate according to the disclosure.

FIG. 2 is a perspective diagram of a light emitting unit 200 provided in the light emitting apparatus according to one embodiment of the disclosure. FIG. 3 is a lateral diagram of the light emitting unit 200 shown in FIG. 2. FIG. 4 is a perspective diagram illustrating a first embodiment of a heat radiation plate according to the disclosure.

The light emitting unit 200 includes a light emitting part (210, see FIG. 9) and a base part 240 in which the light emitting part 210 is coupled.

The light emitting unit 200 includes a plurality of heat pipes 250 fixed to the base part 240.

A predetermined portion of a heat pipe 250 may be fixed to the base part 240 closely and the other portion of the heat pipe 250 is extended from the base part 240 a preset angle. The other portion of the heat pipe 250 may be extended along a longitudinal direction to lie at right angles with respect to the base part 240.

Figure 8:
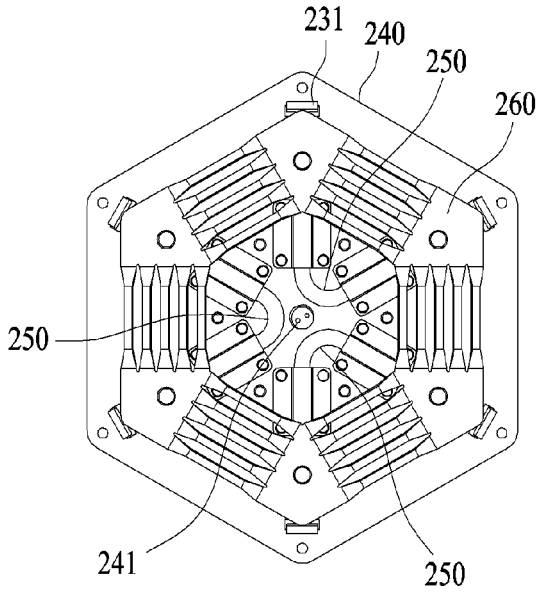
FIG. 8 is a rear view of a light emitting unit according to the disclosure.

Specifically, the heat pipe 250 may have an approximately U-shape (see FIG. 8).

At this time, a fixed end (the predetermined portion) of the heat pipe 250 is closely in contact with the base part 240 and a free end (the other portion) of the heat pipe 250 may be extended to in a direction far from the base part 240.

The heat pipe 250 performs a function of flowing and emitting the heat generated in the light emitting unit.

In one embodiment, working fluid may be provided in the heat pipe 250 and the heat pipe 250 may be formed in a different material from the base part 240.

The light emitting unit 200 includes a plurality of heat radiation plates 260 having a plurality of insertion holes 262 for inserting the plurality of the heat pipes 250 and a flow hole 261 for flow of external air, respectively.

As mentioned above, the heat pipe 250 may be extended along a longitudinal direction to lie at right angles with respect to the base part 240.

The plurality of the heat radiation plates 260 may be disposed along the longitudinal direction of the heat pipe 259 in a multilayer structure. In other words, the plurality of the heat radiation plates 260 may be disposed along a direction to a central shaft (L), spaced apart a predetermined distance from each other.

At this time, the plurality of the heat radiation plates 260 may be arranged for a radial direction to lie at right angles to the longitudinal direction of the heat pipe 250.

Two neighboring heat radiation plates 260 may be spaced apart a predetermined distance from each other. The plurality of the heat radiation plates 260 may be disposed apart an equal distance from each other.

The heat radiation plate 260 may have a hexagonal ring shape. The flow hole 261 is provided in a central portion of the heat radiation plate 260.

The plurality of the insertion holes 262 may be provided along a circumferential direction (C) of the heat radiation plate 250 with respect to the flow hole 261. The number of the insertion holes 262 may be equal to the number of free ends of the heat pipe 250.

It is important to determine a diameter of the flow hole 261 for the flow hole 261 to have a preset cross section area. In other words, an air passage of external air through the flow hole 261 is functioned to enhance a heat radiation characteristic of the lighting apparatus 1.

In one embodiment, the diameter of the flow hole 261 may be larger than the diameter of the insertion hole 262.

The flow hole 261 may have a hexagonal shape. The diameter of the flow hole 261 may be 0.3 to 0.7 times as large as the diameter of the heat radiation plate.

The shape and diameter of the flow hole 261 may be determined diversely based on the result of heat radiation simulation extracted from the output of the lighting apparatus 1. (see FIG. 7)

The heat radiation plate 260 may be formed of a metallic material with an advanced thermal-conductivity. In one embodiment, the heat radiation plate 260 may be formed of aluminum. The heat radiation plate 260 may be formed of a different material from the heat pipe 250.

Moreover, the diameter of the heat radiation plate 260 may be smaller than a diameter of the base part 240. A heat radiation plate 260 adjacent to the base part 240 may be spaced apart a predetermined distance from the base part 240.

Referring to FIG. 3, a distance between the base part 240 and the heat radiation plate 260 may be determined larger than a distance between two neighboring heat radiation plates 260.

A plurality of auxiliary pin arrays 263 having a plurality of auxiliary pins 264 inclined a preset angle, respectively, may be provided in each of the heat radiation plate 260.

The auxiliary pin array 263 may be provided in a space formed between two neighboring insertion holes 262.

The plurality of the auxiliary pins 264 provided in the auxiliary pin array 263 may be spaced apart a predetermined distance from each other along a radial direction (R) of the heat radiation plate 260.

The auxiliary pins 264 may be inclined a preset angle toward the flow hole 261.

In one embodiment, the auxiliary pin 264 may be inclined approximately 20° to 70° from the radial direction (R) of the heat radiation plate 260 toward the flow hole 261.

When the light emitting unit 200 is provided with the power, a high temperature heat is generated in the light emitting part 210.

At this time, the heat generated from the light emitting unit 210 is transmitted to the base part 240, the heat pipe 250 and each of the heat radiation plates 260. The heat radiation plate 260 increases an area of air convection heat exchange.

Specifically, a first direction air passage (P1) may be provided along a space between flow holes 261 of neighboring heat radiation plates 260. At this time, the first direction air passage (P1) may be corresponding to a central shaft (L) direction of the heat radiation plate 260.

The first direction air passage (P1) may be substantially in parallel to the central shaft direction of the heat radiation plate 260.

A second direction air passage (P2) may be provided in a space formed between neighboring heat radiation plates 260. The second direction air passage (P2) may be corresponding to a radial direction Ⓡ of the heat radiation plate 260.

The second direction air passage (P2) may be substantially in parallel to a radial direction (R) of the heat radiation plate 260.

The first direction air passage (P1) may be in communication with the second direction air passage (P2). In other words, the air flowing along the first direction air passage (P) may flow along the second direction air passage (P2).

In addition, the first direction air passage (P1) and the second direction air passage (P2) may be inclined a preset angle. In one embodiment, the first direction air passage (P1) and the second direction air passage (P2) may substantially meet at right angles to each other.

For that, two neighboring heat radiation plates 260 may be spaced apart a preset distance from each other, in parallel. The two neighboring heat radiation plates 260 may be arranged for central shafts to correspond to each other.

While external air is passing through the auxiliary pin 264, a third direction air passage (P3) may be formed of which a direction is different from the first and second direction air passages (P1 and P2). At this time, the first direction air passage (P1), the second direction air passage (P2) and the third direction air passage (P3) may be in communication with each other.

Specifically, the air flowing through the second direction air passage (P2) may flow through the third direction air passage (P3). Also, the air flowing through the third direction air passage (P3) may flow through the second direction air passage (P2).

The external air flowing through the second direction air passage and the third direction air passage (P3) may flow through the first direction air passage (P1).

In brief, a preset region of the second direction air passage (P2) is united with or branched from a preset region of the third direction air passage (P3). In addition, a preset region of the first direction passage (P1) is united with or branched from a preset region of the second direction passage (P2).

Two neighboring air passages can accelerate flow of the external air through the neighboring air passage.

Figure 5:
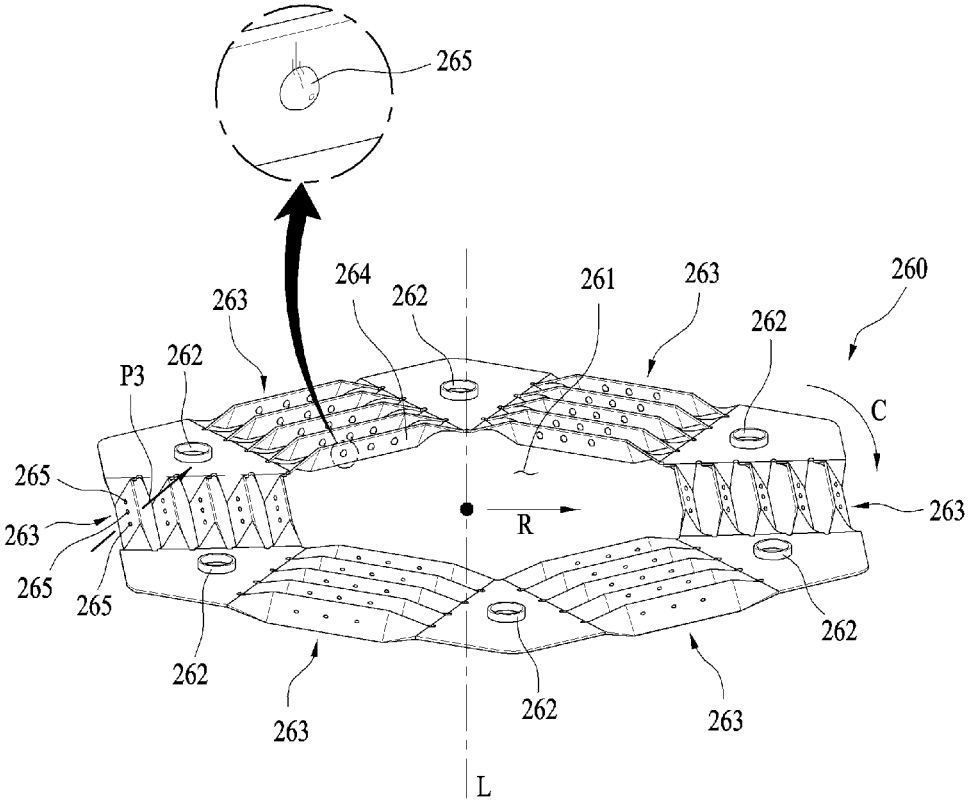
FIG. 5 I a perspective diagram illustrating a second embodiment of a heat radiation plate according to the disclosure.

FIG. 5 is a perspective diagram illustrating a second embodiment of the heat radiation plate 260 according to the disclosure.

Referring to FIG. 5, a turbulence generation unit is provided in the auxiliary pin 264 to generate turbulence flow when external air is flowing. At this time, the turbulence generation unit may include a plurality of dimples 265 formed in once surface of the auxiliary pin 264.

The dimple 265 may be projected toward the flow hole 261 and it may be integrally formed with the heat radiation plate 260. Meanwhile, it is possible for the dimple 265 to be projected toward an outer radial direction of the heat radiation plate 260.

The turbulence generation unit may generate turbulence flow in the external air passing through the third direction air passage (P3).

Figure 6:
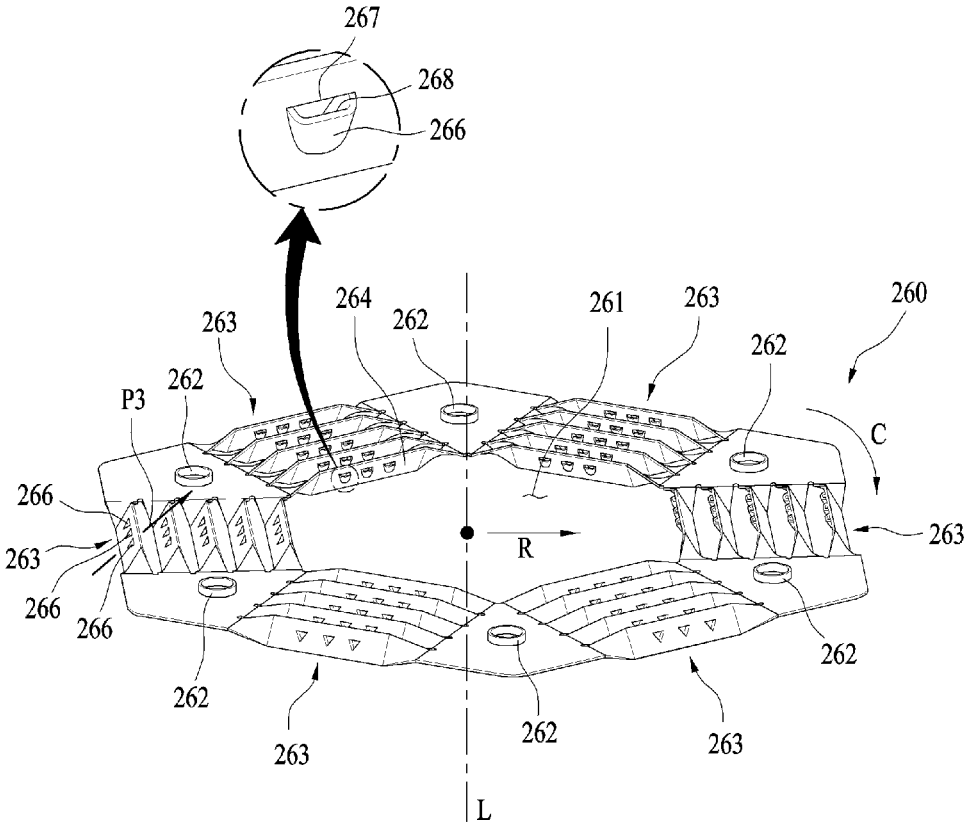
FIG. 6 is a perspective diagram illustrating a first embodiment of a heat radiation plate according to the disclosure.

FIG. 6 is a perspective diagram illustrating a third embodiment of the heat radiation plate 260 according to the disclosure.

Referring to FIG. 6, the turbulence generation unit may include a flow guide unit 266 for guiding the air flowing to one surface of the auxiliary pin 264 to the other surface of the auxiliary pin 264, when the external air is passing through the auxiliary pin 264.

The flow guide unit 266 may bypass the external flowing toward one surface of the auxiliary pin 264 to the other surface of the auxiliary pin 264 partially.

For that, the flow guide unit 266 include a first flow hole 267 formed in the surface of the auxiliary pin 264 and a second flow hole 268 open toward the flow hole 261. In this instance, the first flow hole 267 and the second flow hole 268 may be inclined a preset angle.

The flow guide unit 266 may integrally formed with the heat radiation plate 260.

The turbulence generation unit 265 and 266 may generate the turbulence flow in the external air flowing through the third direction air passage (P3), only to enable improvement of a heat radiation ability of the light emitting unit 200.

Figure 7:
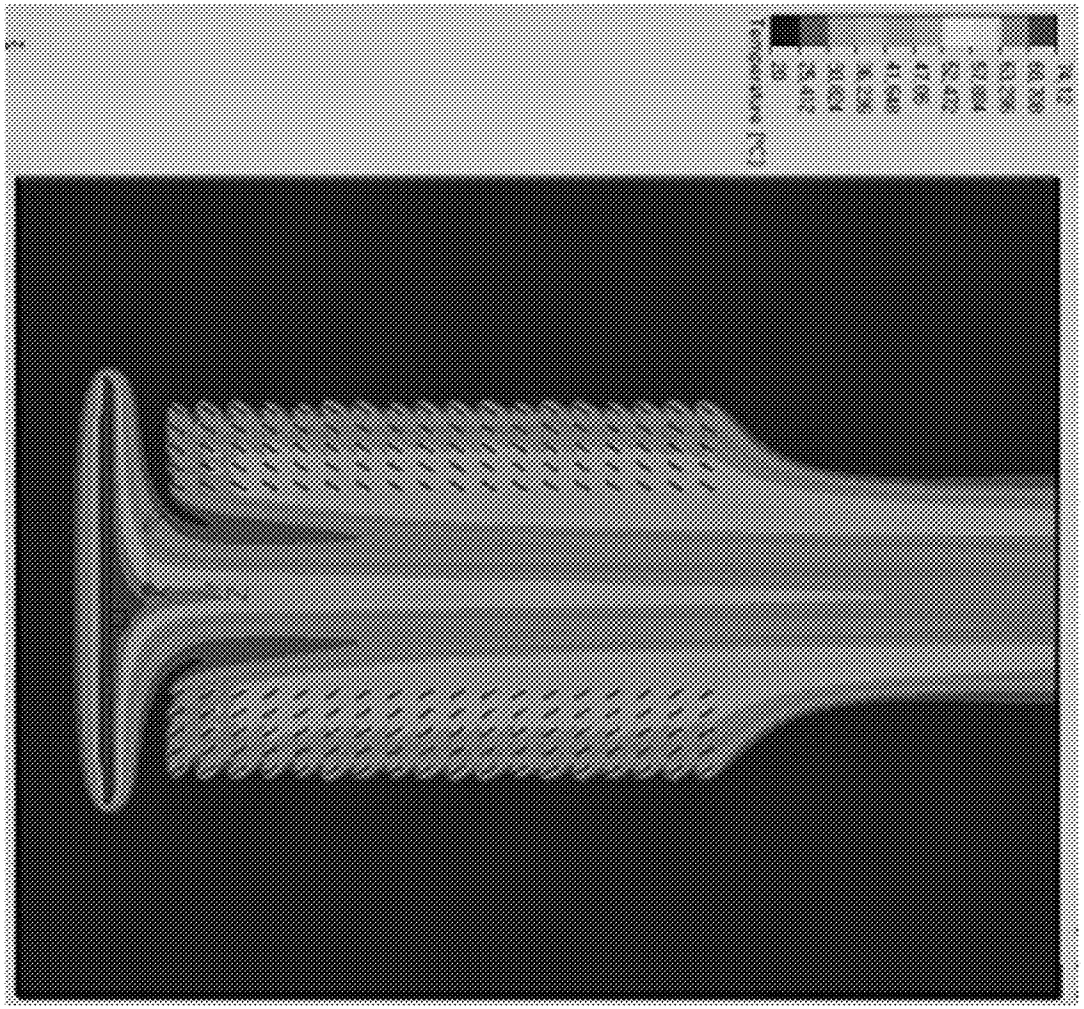
FIG. 7 is a diagram illustrating a heat radiation effect of a lighting apparatus according to one embodiment of the disclosure.

FIG. 7 is a diagram illustrating a heat radiation effect of a lighting apparatus according to one embodiment of the disclosure.

Referring to FIG. 7, it is shown that a first direction air passage (P1) is formed along a space between flow holes 261 of neighboring heat radiation plates 260.

It is also shown that a second direction air passage (P2) is formed in a space between two heat radiation plates 260. A third direction air passage (P3) is formed of which a direction is different from the first and second direction air passages (P1 and P2), while external air is passing through the auxiliary pin 264.

It can be identified that the heat generated from the light emitting unit 210 is effectively emitted through the heat pipe 250 and the heat radiation plate 260.

The temperature in the central region of the heat radiation plate 260 is lowered by the first direction air passage (P1) noticeably.

FIG. 8 is a rear view of a light emitting unit according to the disclosure. FIG. 9 is a front view of the light emitting unit according to the disclosure.

A penetration hole 241 is provided in the base part 240 to penetrate a cable (not shown) electrically connected to the light emitting part 210. The cable may be exhausted outside via the flow hole 261 of the heat radiation plate 260.

The cable may connect the light emitting part and the electric control unit 140 with each other. At this time, the cable may pass the penetration hole 241 and the flow holes 261 of the heat radiation plates 260 sequentially.

Figure 10:
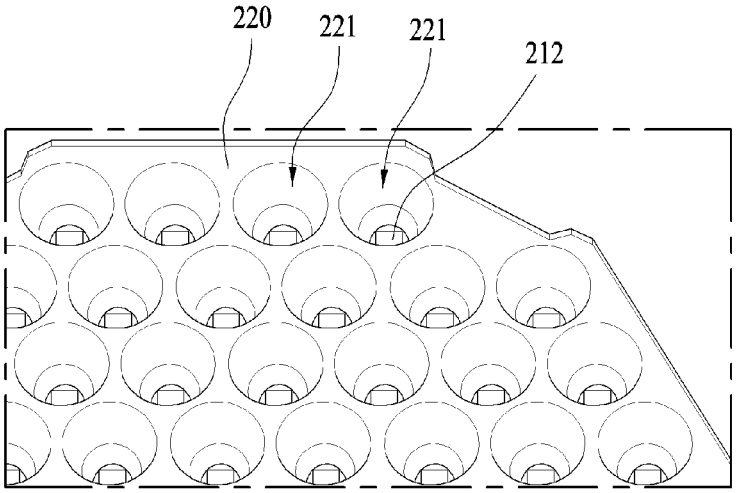
FIG. 10 is a perspective diagram of the light emitting unit according to the disclosure.
Figure 11:
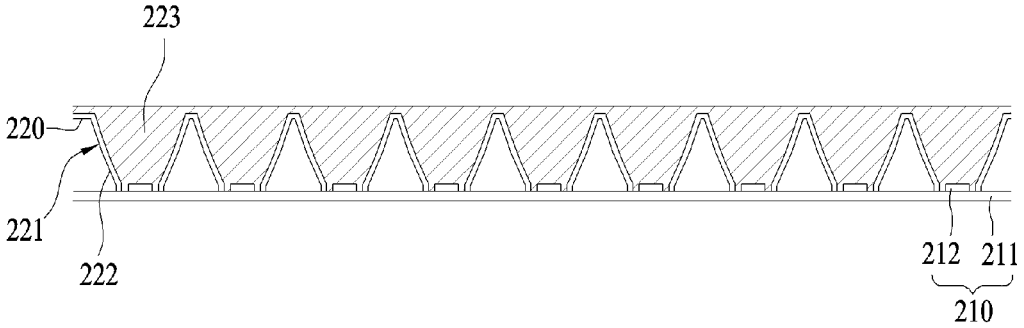
FIG. 11 is a sectional diagram of the light emitting unit shown in FIG. 10.

FIG. 10 is a perspective diagram of the light emitting unit according to the disclosure. FIG. 11 is a sectional diagram of the light emitting unit shown in FIG. 10.

The light emitting part 210 may include a substrate 211 in which a plurality of LEDs 212 are mounted. The light emitting part 210 may include a metallic substrate 211 to enhance a heat transmission performance.

The light emitting part 210 may include a reflective member 220 surrounding each of the LEDs 212. The reflective member 220 may reflect the light irradiated from the LEDs 212.

The reflective member 220 may include a plurality of recesses 221 to surround the LEDs 212, respectively. Each of the recesses 221 has a diameter which is getting larger as getting farther from each of the LEDs 212.

Each of the recesses 221 may have an inclined surface 222 with a diameter getting larger as getting farther from each of the LEDs 212. The recesses 221 may perform a function of reflecting the light irradiated from the LEDs 212 located therein outside, with a preset angle of beam spread.

The light emitting part 210 may include a silicon layer 223 filled in the reflective member 220 to surround each of the LEDs 212. At this time, the silicon layer 223 may be provided in each of the recesses 221.

To form the silicon layer 223, silicon is provided in the reflective member 220 and the silicon is hardened.

The reflective member 220 is coupled to the substrate 211 in which the plurality of the LEDs 212 are provided. After that, liquid mixed with silicon and a hardener is injected in each of the recesses 221 formed in the reflective member 220.

Once a preset amount of the silicon and hardener is injected, the silicon is hardened at a high temperature or hardened naturally only to form the silicon layer 223.

At this time, the silicon layer 223 is hardened and a water-proof structure of the light emitting part 210 may be then provided. Meanwhile, the silicon layer 223 may be formed of transparent silicon.

The transparent silicon may be equal to or similar to a material used in a top of the LEDs 212. In other words, the transparent silicon may have an equal or similar transmissivity and refractive index to the LEDs 212.

The light emitting part 210 may have not only the water-proof structure but also a refractive index compensation effect enabled by index matching, such that optical efficiency of the light emitting part 210 is increased.

Meanwhile, the light emitting unit 200 may include an optical cover 230 for covering the light emitting part 210. The optical cover 230 may be formed of transparent resin and it may be fixed to the based potion 240.

In one embodiment, the optical cover 230 may be detachably mounted to the base part 240. For that, a mounting projection (231, see FIG. 2) for penetrating the base part 240 may be provided in the optical cover 230.

Figure 12:
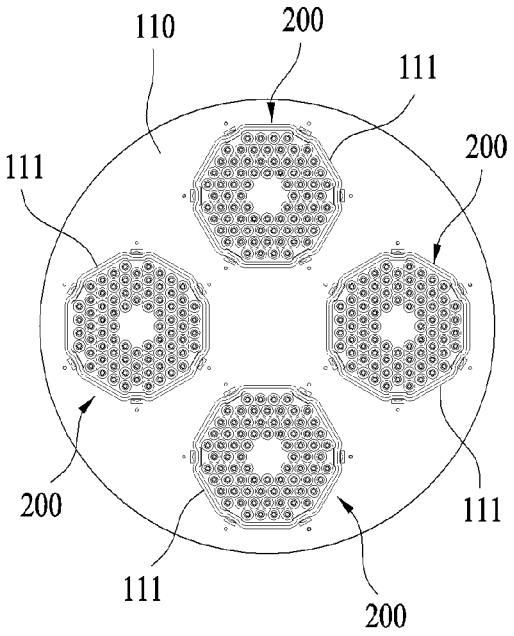
FIG. 12 is a front view of a module type lighting apparatus according to one embodiment of the disclosure.
Figure 12:
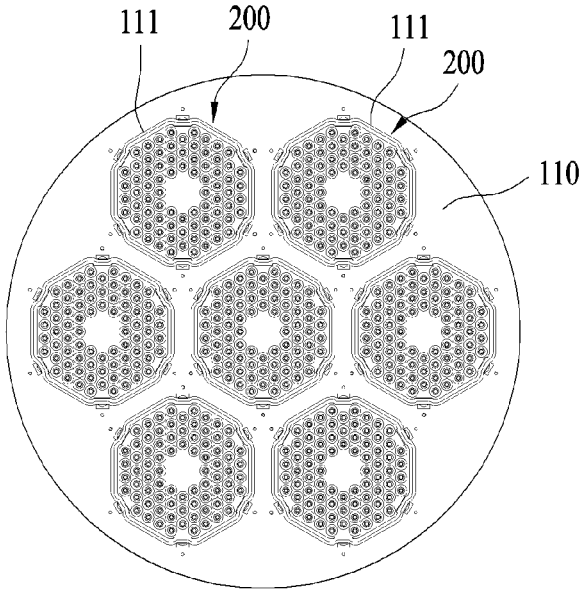

FIG. 12 is a front view of a module type lighting apparatus according to one embodiment of the disclosure.

In this embodiment may be provided a module type lighting apparatus which may selectively increase or decrease the number of the light emitting units 200 mentioned above.

Referring to FIGS. 1 and 12, the module type lighting apparatus 100 include a base plate 110 having a plurality of coupling holes 111 and a plurality of light emitting units 200 coupled to the coupling holes 111.

At this time, the coupling hole 111 and the base part 240 of the light emitting unit 200 may have a hexagonal shape. When the coupling holes 111 are formed in a hexagonal shape in case the base plate 110 has a uniform diameter, more light emitting units 200 can be mounted in the coupling holes 111.

In addition, the module type lighting apparatus 100 includes a cover member 120 coupled to the base plate 110 to cover the light emitting unit 200 and an electric control unit 140 provided in the cover member to supply the power to the light emitting unit 200.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a light emitting part having a LED;

a base part in which the light emitting part is mounted a plurality of heat pipes fixed to the base part; and a plurality of heat radiation plates comprising a plurality of insertion holes to pass the plurality of the heat pipes there through and a flow hole for flowing external air there through, respectively, wherein a plurality of auxiliary pin arrays comprising a plurality of auxiliary pins inclined a preset angle are provided in each of the heat radiation plates, and a turbulence generation unit for generating turbulence flow when external air is flowing is provided in the auxiliary pin.

2. The lighting apparatus of claim 1, wherein the turbulence generation unit comprises a plurality of dimples formed in one surface of the auxiliary pin.

3. The lighting apparatus of claim 2, wherein the dimple is projected toward the flow hole.

4. The lighting apparatus of claim 1, wherein the turbulence generation unit comprises a flow guide unit for guiding the air flowing to one surface of the auxiliary pin to the other surface of the auxiliary pin when external air is passing the auxiliary pin.

5. The lighting apparatus of claim 1, wherein the flow hole is provided in a center of the heat radiation plate, and the plurality of the insertion holes are provided along a circumferential direction with respect to the flow holes, respectively, and the auxiliary pin array is provided in a space between two neighboring insertion holes.

6. The lighting apparatus of claim 5, wherein a plurality of auxiliary pins provided in the auxiliary pin array are spaced apart a preset distance from each other along a radial direction of the heat radiation plate, and the auxiliary pin is inclined toward the flow hole.

7. The lighting apparatus of claim 1, wherein a penetration hole is provided in the base part to penetrate a cable electrically connected to the light emitting part, and the cable is exhausted outside via a flow hole of the heat radiation plate.

8. The lighting apparatus of claim 1, wherein a first direction air passage is provided along a space between flow holes of neighboring heat radiation plates, and a second direction air passage is provided in a space between neighboring heat radiation plates, and a third direction air passage is formed of which a direction is different from the first and second direction air passages, when external air passes the auxiliary pin.

9. The lighting apparatus of claim 8, wherein the first direction air passage and the second direction air passage lie at right angles to each other.

10. The lighting apparatus of claim 1, wherein the light emitting part comprises, a substrate in which a plurality of LEDs are mounted;

a reflective member for surrounding each of the LEDs; and a silicon layer filled in the reflective member to surround each of the LEDs.

11. The lighting apparatus of claim 10, wherein the reflective member comprises a plurality of recesses having a diameter getting larger as farther from each of the LEDs, and the silicon layer is provided in each of the recesses.

12. A lighting apparatus comprising:

a light emitting part having an LED;

a base part in which the light emitting part is mounted;

a plurality of heat pipes fixed to the base part;

a plurality of heat radiation plates comprising a plurality of insertion holes to pass the plurality of the heat pipes there through and a flow hole for flowing external air there through, respectively, wherein a plurality of auxiliary pin arrays comprising a plurality of auxiliary pins inclined a preset angle are provided in each of the heat radiation plates, and the flow hole is provided in a center of the heat radiation plate and the plurality of the insertion holes are provided along a circumferential direction with respect to the flow hole, and the auxiliary pin array is provided in a space between two neighboring insertion holes.

13. The lighting apparatus of claim 12, wherein a plurality of auxiliary pins provided in the auxiliary pin array are spaced apart a preset distance from each other along a radial direction of the heat radiation plate, and the auxiliary pin is inclined toward the flow hole.

14. The lighting apparatus of claim 12, wherein a penetration hole is provided in the base part to penetrate a cable electrically connected to the light emitting part, and the cable is exhausted outside via a flow hole of the heat radiation plate.

15. The lighting apparatus of claim 12, wherein a first direction air passage is provided along a space between flow holes of neighboring heat radiation plates, and a second direction air passage is provided in a space between neighboring heat radiation plates, and a third direction air passage is formed of which a direction is different from the first and second direction air passages, when external air passes the auxiliary pin.

16. The lighting apparatus of claim 15, wherein the first direction air passage and the second direction air passage lie at right angles to each other.

17. The lighting apparatus of claim 12, wherein the light emitting part comprises, a substrate in which a plurality of LEDs are mounted;

a reflective member for surrounding each of the LEDs; and a silicon layer filled in the reflective member to surround each of the LEDs.

18. The lighting apparatus of claim 17, wherein the reflective member comprises a plurality of recesses having a diameter getting larger as farther from each of the LEDs, and the silicon layer is provided in each of the recesses.

19. The lighting apparatus of claim 12, wherein a turbulence generation unit for generating turbulence flow when external air is flowing is provided in the auxiliary pin.

20. The lighting apparatus of claim 19, wherein the turbulence generation unit is a plurality of dimples formed in one surface of the auxiliary pin or a flow guide unit for guiding the air flowing to one surface of the auxiliary pin to the other surface of the auxiliary pin, when air passes the auxiliary pin.

* * * * *